US008137075B2

(12) United States Patent
Howe et al.

(10) Patent No.: US 8,137,075 B2
(45) Date of Patent: Mar. 20, 2012

(54) COMPRESSOR IMPELLERS, COMPRESSOR SECTIONS INCLUDING THE COMPRESSOR IMPELLERS, AND METHODS OF MANUFACTURING

(75) Inventors: William J. Howe, Chandler, AZ (US); Harry L. Kington, Scottsdale, AZ (US); James Neumann, Tempe, AZ (US)

(73) Assignee: Honeywell International Inc., Morristown, NJ (US)

( * ) Notice: Subject to any disclaimer, the term of this patent is extended or adjusted under 35 U.S.C. 154(b) by 1236 days.

(21) Appl. No.: 11/848,435

(22) Filed: Aug. 31, 2007

(65) Prior Publication Data

US 2009/0056125 A1 Mar. 5, 2009

(51) Int. Cl.
*F03B 3/12* (2006.01)

(52) U.S. Cl. ..... 416/241 R; 416/185

(58) Field of Classification Search ..... 416/241 R, 416/241 A, 185, 223 R
See application file for complete search history.

(56) References Cited

U.S. PATENT DOCUMENTS

| | | | | |
|---|---|---|---|---|
| 2,623,727 | A | 12/1952 | McLeod | |
| 2,757,901 | A | 8/1956 | McVeigh | |
| 4,213,738 | A | 7/1980 | Williams | |
| 4,273,512 | A | 6/1981 | Weiler | |
| 4,335,997 | A | 6/1982 | Ewing et al. | |
| 4,536,932 | A | 8/1985 | Athey | |
| 4,581,300 | A | 4/1986 | Hoppin, III et al. | |
| 4,587,700 | A | 5/1986 | Curbishley et al. | |
| 4,787,821 | A | 11/1988 | Cruse et al. | |
| 4,850,802 | A | 7/1989 | Pankratz et al. | |
| 5,061,154 | A | 10/1991 | Kington | |
| 5,556,257 | A | 9/1996 | Foster et al. | |
| 6,276,896 | B1 | 8/2001 | Burge et al. | |
| 6,974,508 | B1 * | 12/2005 | Gabb et al. | 148/428 |
| 7,097,422 | B2 | 8/2006 | Rice et al. | |
| 2003/0167775 | A1 | 9/2003 | Soechting et al. | |
| 2006/0034695 | A1 | 2/2006 | Hall et al. | |
| 2006/0039791 | A1 * | 2/2006 | Kim | 416/228 |

* cited by examiner

*Primary Examiner* — Edward Look
*Assistant Examiner* — Dwayne J White
(74) *Attorney, Agent, or Firm* — Ingrassia Fisher & Lorenz, P.C.

(57) ABSTRACT

Compressor impellers, compressor sections, and methods of manufacturing compressor impellers and cooling the compressor impellers are provided. In an embodiment, and by way of example only, a compressor impeller includes a bore section and a rim section. The bore section comprises a first nickel-based alloy and includes an inner disk portion and a first plurality of blade portions extending therefrom. The rim section comprises a second nickel-based alloy and includes an outer disk portion and a second plurality of blade portions. The outer disk portion is bonded to the inner disk portion of the bore section, and the second plurality of blade portions is bonded to the first plurality of blade portions of the bore section.

11 Claims, 4 Drawing Sheets

COMPRESSOR IMPELLERS, COMPRESSOR SECTIONS INCLUDING THE COMPRESSOR IMPELLERS, AND METHODS OF MANUFACTURING

TECHNICAL FIELD

The inventive subject matter generally relates to engines, and more particularly relates to compressor impellers for compressor sections of turbine engines.

BACKGROUND

A gas turbine engine may be used to power various types of vehicles and systems. A particular type of gas turbine engine that may be used to power aircraft is a turbofan gas turbine engine. A turbofan gas turbine engine may include, for example, a fan section, a compressor section, a combustor section, a turbine section, and an exhaust section. The fan section induces air from the surrounding environment into the engine and accelerates a fraction of the air toward the compressor section. The remaining fraction of air is accelerated into and through a bypass plenum, and out the exhaust section.

The compressor section, which may include a high pressure compressor and a low pressure compressor, raises the pressure of the air it receives from the fan section to a relatively high level. The compressed air then enters the combustor section, where a ring of fuel nozzles injects a steady stream of fuel into a plenum. The injected fuel is ignited to produce high-energy compressed air. The air then flows into and through the turbine section causing turbine blades therein to rotate and generate energy. This energy is used to power the fan and compressor sections. The air exiting the turbine section is exhausted from the engine via the exhaust section, and the energy remaining in the exhaust air aids the thrust generated by the air flowing through the bypass plenum.

As the desire for greater power output and smaller packaging continues to increase, gas turbine engines have been configured to operate at higher temperatures and at high pressures. For example, compressor sections are increasingly being designed to operate at high pressure ratios (e.g., ratios of greater than about 35). However, these pressure ratios tend to cause the air flowing through the compressor section to exit at extreme high temperatures (e.g., above about 675° C.). Consequently, the materials conventionally used to manufacture some of the compressor components (such as monolithic titanium for impellers) may not be suitable for use in such environments.

Accordingly, it is desirable to have improved compressor components, such as impellers, that are adapted to operate under extreme conditions. In addition, it is desirable for the compressor component to be capable of operating in compressor sections that employ pressure ratios of greater than about 35, and which may yield air having temperatures of greater than about 675° C. Furthermore, other desirable features and characteristics of the inventive subject matter will become apparent from the subsequent detailed description of the inventive subject matter and the appended claims, taken in conjunction with the accompanying drawings and this background of the inventive subject matter.

BRIEF SUMMARY

Compressor impellers, compressor sections, and methods of manufacturing compressor impellers are provided.

In an embodiment, and by way of example only, a compressor impeller includes a bore section and a rim section. The bore section comprises a first nickel-based alloy and includes an inner disk portion and a first plurality of blade portions extending therefrom. The rim section comprises a second nickel-based alloy and includes an outer disk portion and a second plurality of blade portions. The outer disk portion is bonded to the inner disk portion of the bore section, and the second plurality of blade portions is bonded to the first plurality of blade portions of the bore section.

In another embodiment, by way of example only, a compressor section is provided that includes a compressor impeller and a cooling line. The compressor impeller includes a bore section and a rim section. The bore section comprises a first nickel-based alloy and includes an inner disk portion and a first plurality of blade portions extending therefrom. The rim section comprises a second nickel-based alloy and includes an outer disk portion and a second plurality of blade portions. The outer disk portion is bonded to the inner disk portion of the bore section, and the second plurality of blade portions is bonded to the first plurality of blade portions of the bore section. The cooling line extends axially along a length of the compressor impeller and includes an inlet and an outlet. The inlet is disposed adjacent the forward face of the compressor impeller to divert air from an airflow forward the forward face into the cooling line, and the outlet is disposed adjacent to the aft face of the compressor impeller to direct the air from the airflow to the aft face.

In still another embodiment, by way of example only, a method is provided for manufacturing a compressor impeller having a bore section and a rim section disposed radially outwardly relative to the bore section. The method includes forging the bore section from a first nickel-based alloy, casting the rim section from a second nickel-based alloy, and bonding the forged bore section and cast rim section together to form the compressor impeller.

BRIEF DESCRIPTION OF THE DRAWINGS

The inventive subject matter will hereinafter be described in conjunction with the following drawing figures, wherein like numerals denote like elements.

DETAILED DESCRIPTION

The following detailed description is merely exemplary in nature and is not intended to limit the inventive subject matter or the application and uses of the inventive subject matter. Furthermore, there is no intention to be bound by any theory presented in the preceding background or the following detailed description.

Figure 1:
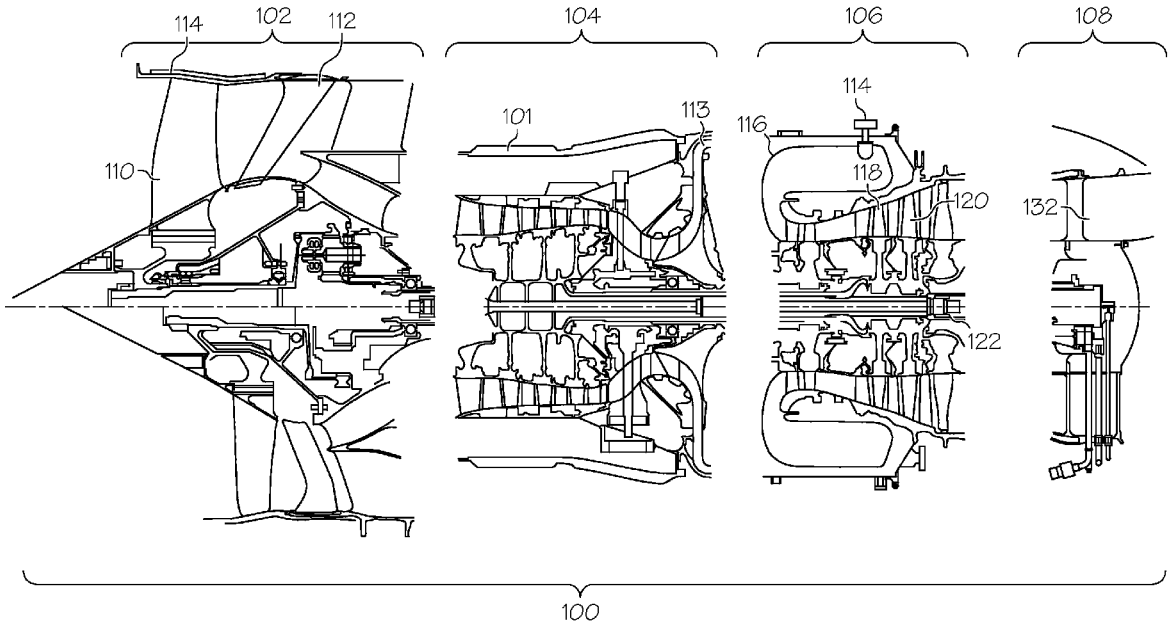
FIG. 1 is a partial cross-sectional side view of a turbofan jet engine, according to an embodiment.

FIG. 1 is a partial cross-sectional side view of a turbofan jet engine 100, according to an embodiment. The turbofan jet engine 100 is disposed in an engine case 101 and includes a fan section 102, a compressor section 104, a combustor and turbine section 106, and an exhaust section 108. The fan section 102 is positioned at the front, or "inlet" section of the engine 100, and includes a fan 110 that induces air from the surrounding environment into the engine 100. The fan section 102 accelerates a fraction of this air toward the compressor section 104, and the remaining fraction is accelerated into and through a bypass 112, and out the exhaust section 108. The compressor section 104 raises the pressure of the air it receives to a relatively high level.

The high-pressure compressed air is diffused by a diffuser 113 and then enters the combustor and turbine section 106, where a ring of fuel nozzles 114 (only one illustrated) injects a steady stream of fuel into a combustor 116. The injected fuel is ignited by a burner (not shown), which significantly increases the energy of the high-pressure compressed air in the combustor 116. This high-energy compressed air then flows first into a high pressure turbine 118 and then a low pressure turbine 120, causing rotationally mounted turbine blades on each turbine 118, 120 to turn and generate energy.

The energy generated in the turbines 118, 120 is used to power other portions of the engine 100, such as the fan section 102 and the compressor section 104. In particular, a high pressure turbine 118 drives the high pressure compressor 113 while a low pressure turbine, 120 drives a shaft 122 that extends through the engine 100 and the fan section 102 and is mounted to the rotor 122. The air exiting the combustor and turbine section 106 then leaves the engine 100 via the exhaust section 108. The energy remaining in the exhaust air aids the thrust generated by the air flowing through the bypass 112.

Figure 2:
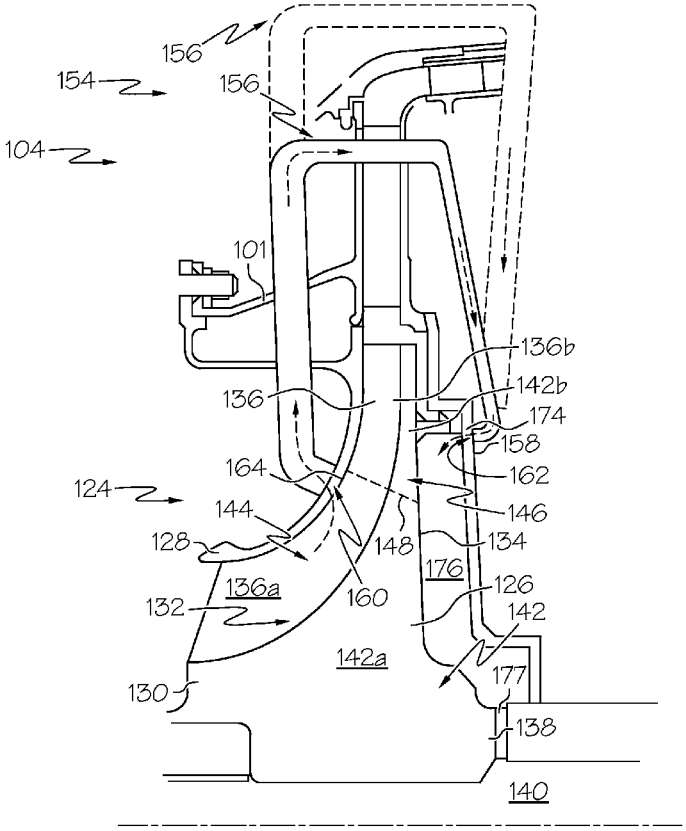
FIG. 2 is a close-up cross-sectional view of a portion of a compressor section, according to an embodiment.

FIG. 2 is a close-up, cross-sectional view of a portion of the compressor section 104 coupled to the diffuser 113, according to an embodiment. The compressor section 104 comprises a compressor 124 that has an impeller 126 and a shroud 128. The impeller 126 may include a hub 130 having a first or "forward" face 132, a second or "aft" face 134, and a plurality of blades 136 extending from the forward face 132. The hub 130 may be made up of a rotor 138 having a bore 140 therethrough and a disk 142 extending radially outwardly from the bore 130. The shroud 128 extends along the impeller 126 and may be coupled to a portion of the engine case 101. In an embodiment, the engine case 101 may include openings and chambers through which portions of the airflow may be diverted.

To allow the compressor 124 to operate at pressure ratios of greater than about 35 and to be capable of being subjected to temperatures greater than about 675° C., the impeller 126 may have a bore section 144 comprising a nickel-based alloy material having a first property and a rim section 146 comprising a nickel-based alloy material having a second property. For example, the bore section 144 may be subjected to forces greater than those that may be imparted on the rim section 146 and to temperatures less than those that may be exposed to the rim section 146. Thus, in an embodiment, the bore section 144 may be made of a material that is capable of withstanding high stress (e.g., about 1100 MPa) at temperatures such as those below about 675° C. In this regard, in an embodiment, the bore section 144 may be a forging comprising the nickel-based alloy. For example, but not by way of limitation, the nickel-based alloy, may be Astroloy™ or Alloy 10 (each available through Crucible Compaction Metals of Syracuse, N.Y.).

The rim section 146 may be subjected to temperatures that are higher than those to which the bore section 144 may be subjected and may be made of nickel-based alloy material that is capable of maintaining structural integrity when exposed to high temperature (e.g., temperatures greater than about 675° C.) and lower stress (e.g., less than about 850 MPa). In an embodiment, the rim section 146 may be an equiaxed single crystal material such as MarM247 (available through Alcoa Howmet of Whitehall, Mich.). The nickel-based cast material may have substantially the same formulation as the nickel-based alloy of the bore section 144. In another embodiment, the cast material may have a different formulation than that of the bore section 144.

The bore and rim sections 144, 146 may be bonded together via press fitting, interference fitting, or welding to form a bond line 148 therebetween. In an embodiment, the bore and rim sections 144, 146 are formed such that the bond line 148 divides the disk 142 into an inner disk portion 142*a* on the bore section 144 and an outer disk portion 142*b* on the rim section 146. The blades 136 may also be divided such that a first plurality of blade portions 136*a* is on the bore section 144 and a second plurality of blade portions 136*b* is on the rim section 146.

Figure 3:
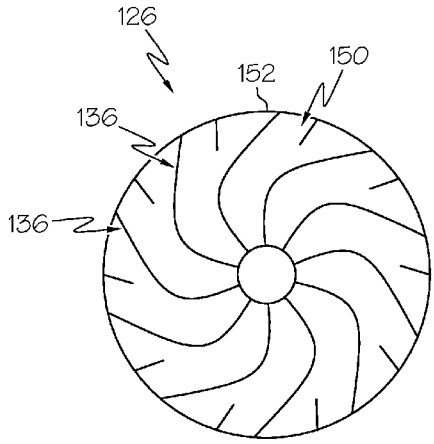
FIG. 3 is a perspective view of an impeller, according to an embodiment.
Figure 4:
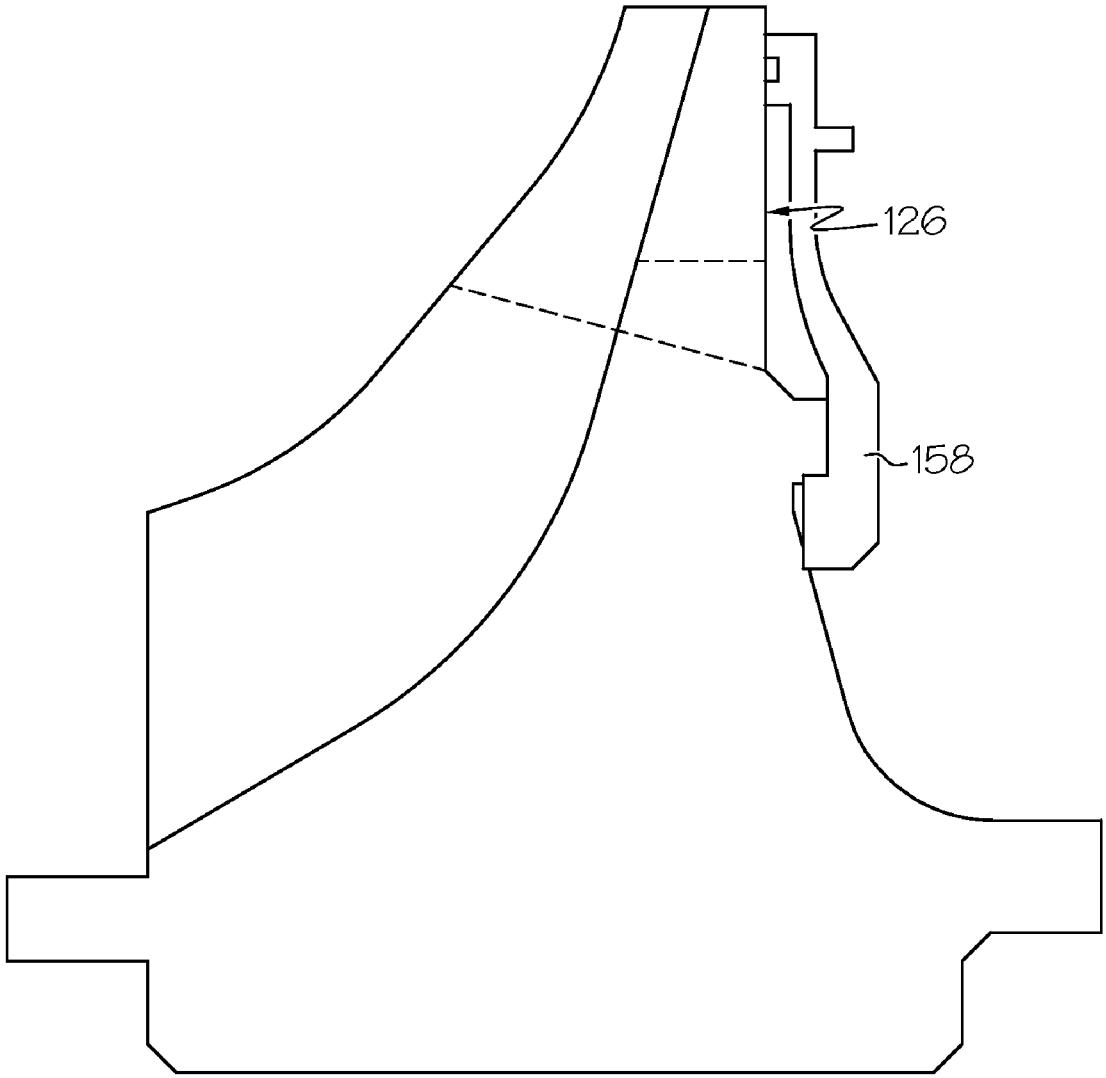
FIG. 4 is a cross-sectional view of a portion of a compressor section, according to another embodiment.

In an embodiment, a plurality of radial slots 150 (FIG. 3) may be included in the rim section 146 to reduce thermally induced stresses thereof. FIG. 3 is a perspective view of the impeller 126 including radial slots 150, according to an embodiment. The radial slots 150 extend from an edge 152 of the impeller 126 to a location radially inward therefrom, which may or may not be the bond line 148. The radial slots 150 may be formed between each blade 136 or between selected ones of the blades 136. Returning to FIG. 2, in any case, a seal 158, which may be a seal plate may be coupled to the aft face 134 of the impeller 126 to prevent air from flowing past the impeller 126. In this regard, the seal 158 covers at least a radial length of the radial slots 150 and may be disposed on an outer section of the seal 158. Alternatively, the seal 158 may be disposed on the entire aft face 134 of the impeller 126. Additionally, the seal 158 may be mounted directly to the impeller 126, as shown in FIG. 4.

To manufacture the impeller 126 described above, according to an embodiment, the rim section 136 may be cast from a first nickel-based alloy, and the bore section 144 may be forged from a second nickel-based alloy. Next, the forged bore section 144 and cast rim section 146 may be bonded together to form the compressor impeller 126. In an embodiment, one or more radial slots 150 are formed extending from the edge 152 of the rim section 144 to a location radially inwardly therefrom.

Returning to FIG. 2, the impeller 126 may be cooled with a cooling system 154. The cooling system 154 is configured to divert a portion of air from an airflow upstream of the forward face 132 to the aft face 134. In an embodiment, the cooling system 154 may include a cooling line 156 and the seal 158. The cooling line 156 extends axially along a length of the impeller 126 and includes an inlet 160 disposed adjacent the forward face 132 of the impeller 126 and an outlet 162 disposed adjacent the aft face 134. The inlet 160 diverts air from an airflow forward the forward face 132 into the cooling line 156, and the outlet 162 directs the air from the airflow to the aft face 134.

A first opening 164 may be formed in the shroud 128 to thereby allow the inlet 160 suitable access to the airflow upstream of the forward face 132. FIG. 4 is a close-up, cross-sectional view of a portion of the compressor section 104, according to another embodiment. In this embodiment, the first opening 164 is formed in an area of the shroud 128 that is adjacent the engine case 101, which includes a chamber 166 formed therein. The chamber 166 communicates with the first opening 164 to thereby supply air thereto.

Although depicted as being a single pipe, it will be appreciated that the cooling line 156, in an alternative embodiment, may comprise more pipes disposed around a circumference of the impeller 126. The plurality of pipes may be substantially evenly spaced apart, or alternatively may be disposed in any position suitable for supplying air to desired portions of the aft face 134. Additionally, the cooling line 156 may extend to the aft face 134 in any manner. For example, the cooling line 156 may extend through openings 170 formed in the diffuser 113. To provide additional cooling to other portions of the aft face 134, additional cooling lines 156 may extend around an outer periphery of the diffuser 113.

Figure 5:
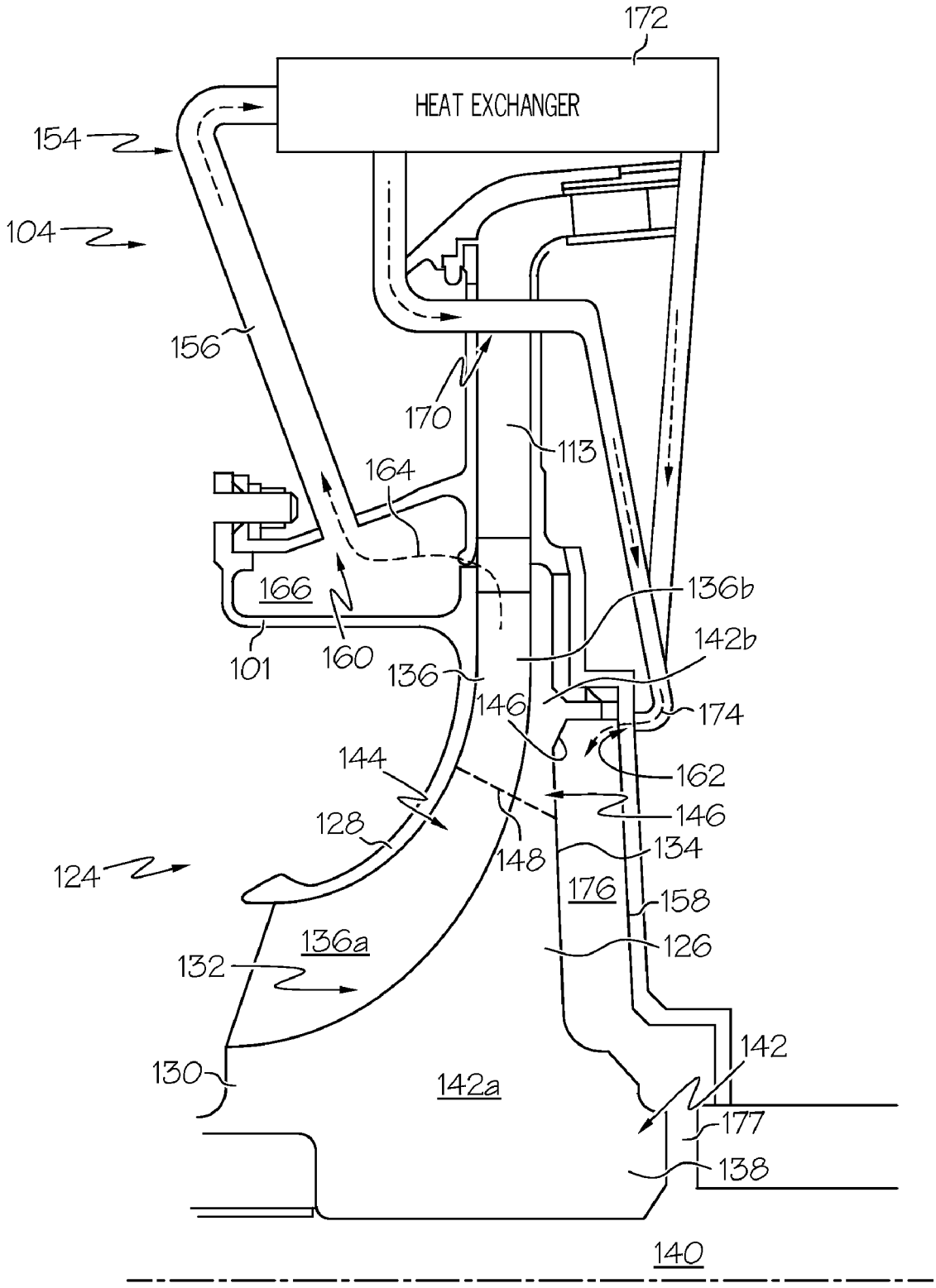
FIG. 5 is a cross-sectional view of a portion of a compressor section, according to still another embodiment.

With continued reference to FIG. 5, a heat exchanger 172 may be included to control the temperature of the air supplied to the aft face 134 of the impeller 126. In an embodiment, the heat exchanger 172 is disposed between the inlet 160 and the outlet 162 of the cooling line 156. Thus, the air may flow into the heat exchanger 172, the heat exchanger 172 may cool the air, and the cooled air may then be exhausted from the heat exchanger 172 at the aft face 134. As shown in FIG. 5, the heat exchanger 172 may be positioned at an outer periphery of the impeller 126; however, it will be appreciated that other suitable locations, depending on the positioning of surrounding components, may alternatively be employed.

As mentioned briefly above, the cooling system 154 may include a seal 158 coupled to the impeller 126. The seal 158 may be used to maintain the cool air from the cooling line 156 proximate the aft face 134. In an embodiment, the seal 158 may be a seal plate that is disposed adjacent the aft face 134 to form an air pocket 176 therewith. The seal plate may have an opening 174 that allows the cooling line outlet 162 to exhaust the cooled air into the air pocket 176. In another embodiment, the seal 158 may be a labyrinth seal mounted to the rotor 138 of the impeller 126. In still another embodiment, the air from the air pocket 176 may be routed through the impeller 126 to other parts of the engine 100 (FIG. 1). In this regard, the rotor 138 may include an opening 177 therein that allows the air to flow into the bore 140 and the seal 158 may prevent air from leaking out of the air pocket 176 to other sections of the engine 100.

Improved components and compressor sections have now been provided. The components and the compressor sections may be capable of operating under extreme conditions. For example, the compressor component may be capable of operating in compressor sections that employ pressure ratios of greater than 35, and which may yield air having temperatures of greater than about 675° C.

While at least one exemplary embodiment has been presented in the foregoing detailed description of the inventive subject matter, it should be appreciated that a vast number of variations exist. It should also be appreciated that the exemplary embodiment or exemplary embodiments are only examples, and are not intended to limit the scope, applicability, or configuration of the inventive subject matter in any way. Rather, the foregoing detailed description will provide those skilled in the art with a convenient road map for implementing an exemplary embodiment of the inventive subject matter. It being understood that various changes may be made in the function and arrangement of elements described in an exemplary embodiment without departing from the scope of the inventive subject matter as set forth in the appended claims.

What is claimed is:

1. A compressor section of an engine comprising:

a compressor impeller including a forward face and an aft face, the compressor impeller comprising:

a bore section comprising a first nickel-based alloy, the bore section including an inner disk portion and a first plurality of blade portions extending axially therefrom, and a rim section comprising a second nickel-based alloy, the rim section including an outer disk portion and a second plurality of blade portions, the outer disk portion bonded to the inner disk portion of the bore section and the second plurality of blade portions bonded to the first plurality of blade portions of the bore section; and a cooling line extending axially along a length of the compressor impeller, the cooling line including an inlet and an outlet, the inlet disposed adjacent the forward face of the compressor impeller to divert air from an airflow forward the forward face into the cooling line, and the outlet disposed adjacent to the aft face of the compressor impeller to direct the air from the airflow to the aft face.

2. The compressor section of claim 1, further comprising a heat exchanger disposed between the inlet and the outlet of the cooling line.

3. The compressor section of claim 1, further comprising a shroud extending along the compressor impeller, the shroud including an opening formed therein with which the cooling line communicates.

4. The compressor section of claim 1, further comprising a diffuser in flow communication with the compressor impeller, the diffuser having an outer periphery and wherein at least a portion of the cooling line extends radially outwardly relative to the diffuser.

5. The compressor section of claim 1, further comprising a diffuser in flow communication with the compressor impeller, the diffuser having an outer periphery, and wherein at least a portion of the cooling line extends between the compressor impeller and the diffuser outer periphery.

6. The compressor section of claim 1, further comprising a seal plate mounted adjacent to the aft face of the compressor impeller to form an air pocket therebetween, the seal plate including an opening formed therein in communication with the outlet of the cooling line.

7. The compressor section of claim 6, wherein the rim section includes a surface within which a radial slot is formed, and at least a portion of the seal plate is disposed over the slot.

8. The compressor section of claim 1, wherein the first nickel-based alloy comprises a material capable of withstanding a stress of at least about 1100 MPa.

9. The compressor section of claim 8, wherein the second nickel-based alloy comprises a material capable of maintaining structural integrity when exposed to temperatures of at least about 675° C.

10. The compressor section of claim 1, wherein the first nickel-based alloy comprises a forged component and the second nickel-based alloy comprises a cast component.

11. The compressor section of claim 10, wherein the first nickel-based alloy comprises a pressed powder component and the second nickel-based alloy comprises cast component.

* * * * *